US005788622A

United States Patent [19]

Borgström et al.

[11] Patent Number: 5,788,622

[45] Date of Patent: Aug. 4, 1998

[54] OUTLET DEVICE AND A CENTRIFUGAL SEPARATOR PROVIDED WITH SUCH AN OUTLET DEVICE

[75] Inventors: Leonard Borgström, Tyresö; Claes-Göran Carlsson; Peter Franzén, both of Tullinge; Claes Inge, Saltsjö-Duvnäs; Torgny Lagerstedt, Stockholm; Hans Moberg, Stockholm; Stefan Szepessy, Stockholm; Mikael Sundström, Stockholm, all of Sweden

[73] Assignee: Alfa-Laval AB, Lund, Sweden

[21] Appl. No.: 930,019

[22] PCT Filed: Jan. 23, 1997

[86] PCT No.: PCT/SE97/00107

§ 371 Date: Nov. 12, 1997

§ 102(e) Date: Nov. 12, 1997

[87] PCT Pub. No.: WO97/27946

PCT Pub. Date: Aug. 7, 1997

[30] Foreign Application Priority Data

Jan. 29, 1996 [SE] Sweden ..... 9600299

[51] Int. Cl.[6] ..... B04B 1/08; B04B 11/08

[52] U.S. Cl. ..... 494/57; 494/70

[58] Field of Search ..... 494/2–4, 56, 57, 494/67–73; 210/380.1

[56] References Cited

U.S. PATENT DOCUMENTS

| | | | |
|---|---|---|---|
| 3,079,070 | 2/1963 | Thylefors . | |
| 3,333,765 | 8/1967 | Maurer . | |
| 4,005,817 | 2/1977 | Charlton et al. | 494/57 X |
| 4,101,421 | 7/1978 | Hultsch . | |
| 4,525,155 | 6/1985 | Nilsson . | |
| 4,622,029 | 11/1986 | Nilsson . | |
| 5,090,953 | 2/1992 | Buttner et al. . | |
| 5,405,307 | 4/1995 | Borgstrom et al. | 494/57 |

FOREIGN PATENT DOCUMENTS

| | | |
|---|---|---|
| 1381599 | 11/1964 | France . |
| 656125 | 1/1938 | Germany . |
| 1103258 | 3/1961 | Germany . |
| 3940053 | 6/1991 | Germany . |

*Primary Examiner*—Charles E. Cooley

*Attorney, Agent, or Firm*—Fish & Richardson P.C.

[57] ABSTRACT

An outlet device for discharging liquid from a chamber (16) in a centrifugal rotor, that is rotatable around a rotational axis (12), comprises an outlet member (29). This outlet member is turnable around a turning axis (26) in parallel with said rotational axis (12) and is held by a spring (31) pressed radially outwardly in the chamber (16) against and partly into a liquid body rotating with the centrifugal rotor. The outlet member (29), which further forms an outlet channel (34) and an inlet opening (30) communicating therewith, is shaped such that the inlet opening (30) is situated downstream of said turning axis (26) during operation of the centrifugal rotor.

11 Claims, 2 Drawing Sheets

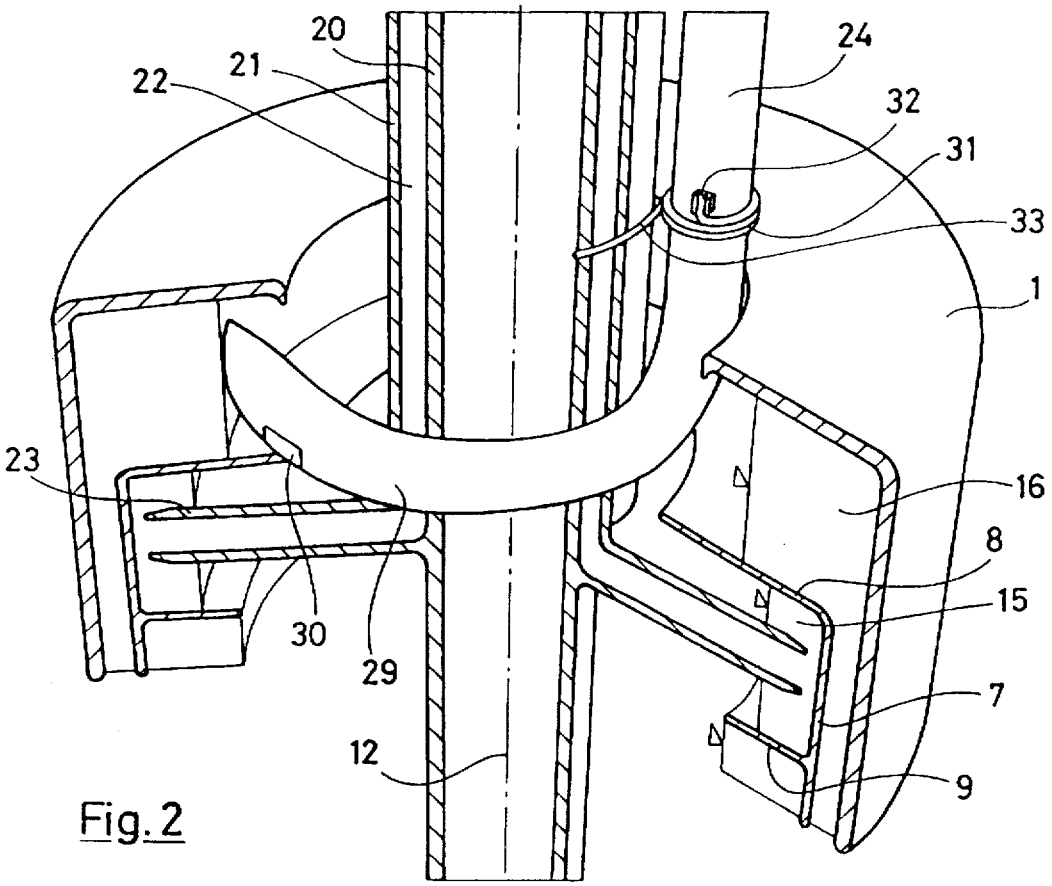
Fig. 2
Fig. 3
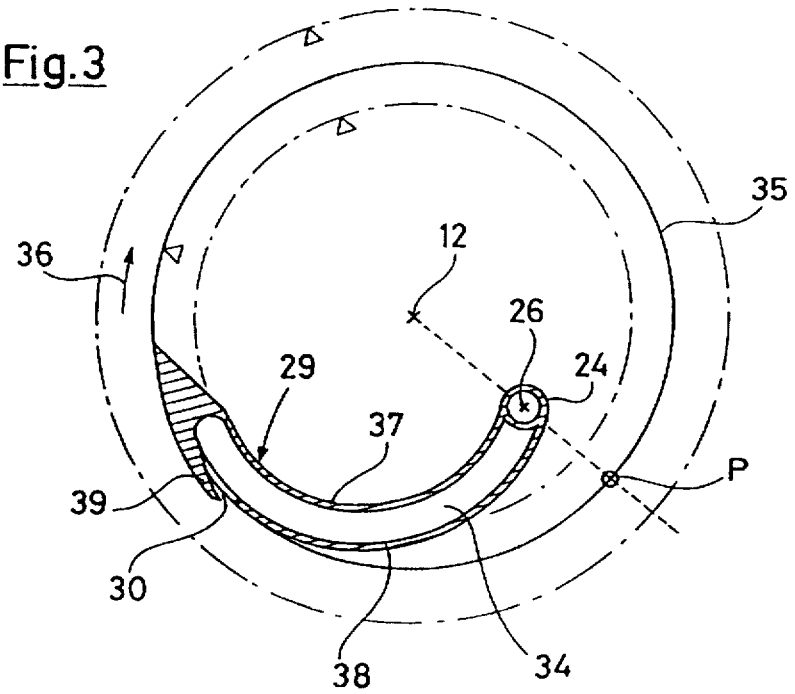

OUTLET DEVICE AND A CENTRIFUGAL SEPARATOR PROVIDED WITH SUCH AN OUTLET DEVICE

FIELD OF THE INVENTION

The present invention relates to an outlet device for a centrifugal rotor that is rotatable around a rotational axis and that delimits a chamber which is formed such that a liquid present therein forms upon rotation of the centrifugal rotor a liquid body having a free liquid surface facing towards and surrounding the rotational axis. The outlet device comprises, firstly, an outlet member which forms an outlet channel and an inlet opening communicating therewith and which is adapted during operation of the centrifugal rotor to be turnable around a turning axis extending substantially in parallel with said rotational axis at some distance therefrom, so that the outlet member is movable in a direction towards or away from the rotational axis of the centrifugal rotor, the outlet member further being formed such that in different turning positions around said turning axis it extends from a liquid free part of said chamber out into the liquid body present therein through said free liquid surface and, secondly, actuation means arranged to actuate the outlet member by a controlled force striving at turning the outlet member around said turning axis in a direction away from the rotational axis of the centrifugal rotor, so that the outlet member, against the action of forces which are exerted thereon by the liquid body rotating with the centrifugal rotor, is held with its inlet opening situated at least partly in the liquid body at varying radial levels of the free liquid surface.

An outlet device of this kind is advantageous because the radially movable outlet member can be brought to accompany radial movements of the free liquid surface in the centrifugal rotor automatically. If desired, this may be used for sensing of the radial position of the liquid surface, or be used only for minimizing the energy consumption caused by the outlet member by its contact with the rotating liquid body. The depth of immersion of the outlet member in the rotating liquid body, thus, may be maintained unchanged independent of the radial position of the liquid surface.

Another advantage with a radially movable outlet member is that upon need the outlet member may be used for a desired adjustment of the radial position of said liquid surface.

BACKGROUND OF THE INVENTION

Previously known outlet devices of the kind here defined, described for instance in DE 656 125 and DE 39 40 053-A1, are not designed in a way making possible a maximum use of said advantages of a radially movable outlet member. Thus, both of the two outlet members shown and described in said two German patent specifications have a form causing a relatively large energy consumption even if the outlet members have a relatively small depth of immersion in the rotating liquid body. Further, the two previously known outlet members are arranged in a way making them instable as level sensing means. Thus, they will not operate satisfactorily if sudden disturbances come up in the rotation of said liquid body, e.g. upon swinging or pendulum movements of the centrifugal rotor. In connection with movements of this kind those forces exerted by the rotating liquid body on the outlet member change very rapidly and, given the design of the previously known outlet members, this may mean that the rotating liquid would press the outlet member much deeper into the liquid body than is desired. This may cause too large oscillations in the radial movements of the outlet member, which do not correspond to the radial movements of the liquid surface itself and which, therefore, do not give a correct signal about the actual radial position of the liquid surface.

SUMMARY OF THE INVENTION

The object of the present invention is to provide an outlet device of the general kind initially defined, which is not connected with the disadvantages of previously known outlet devices just described.

This object may be obtained by the invention if in an outlet device of the initially defined kind the outlet member has a shape such that during operation of the centrifugal rotor it extends from the liquid free part of said chamber out into the liquid body present therein through an area of the free liquid surface, which area is situated downstream of a point on the free liquid surface, which point is situated at a prolongation of a straight line drawn from the rotational axis of the centrifugal rotor through said turning axis. Said area, in which the outlet member extends through the free liquid surface, is thus situated between said point and —seen in the rotational direction of the centrifugal rotor—a place on the free liquid surface, situated diametrically opposite to the said point.

Preferably, said inlet opening in the outlet member, during operation of the centrifugal rotor, is placed such that a radius extending from the rotational axis of the centrifugal rotor through the inlet opening forms an angle between 80° and 100°, preferably around 90°, with said straight line extending through said rotational axis and said turning axis. Hereby, it is achieved that the angle, that is formed between the outlet member and the liquid surface of the rotating liquid body in the area of said inlet opening, will change as little as possible upon radial movements of the liquid surface and the outlet member.

The outlet channel in the outlet member preferably has an extension such that liquid flowing in through the inlet opening during operation of the centrifugal rotor is forced to change its flow direction in the outlet channel in a way such that, thereby, a reaction force will act on the outlet member, which strives at turning the outlet member around said turning axis in a direction towards the rotational axis of the centrifugal rotor.

Furthermore, in a preferred embodiment of the invention at least a part of the outside of the outlet member, being arranged to be in contact with said liquid body, is inclined in relation to the direction of rotation of the liquid body in a way such that the outlet member will be actuated by the rotating liquid body by a lifting force that is counter directed to said controlled force. Preferably, said outside of the outlet member forms an angle smaller than 10° with the free liquid surface in said chamber in the area of said outside having contact with the rotating liquid body in the chamber.

Said controlled force should be independent of forces emanating from the rotation of the liquid body. In the most simple case the controlled force may be obtained by means of a spring of one kind or another. Alternatively, for instance a body (possibly the outlet member itself) may be adapted by its weight and by means of inclined surfaces to cause the outlet member to be pressed by a constant predetermined force outwardly towards and partly into the rotating liquid body. According to a further alternative the controlled force may be accomplished by pneumatic means.

In an outlet device according to the invention the radially movable outlet member may be automatically caused to follow radial movements of the free liquid surface of the rotating liquid body and all the time with great accuracy be kept immersed to a minimum in the liquid body, independent of whether liquid is discharged or not through the outlet device.

In a simple embodiment of the invention the outlet member is not rotatable around the rotational axis of the rotor. Nothing prevents, however, that the invention is used in connection with outlet members rotatable around the rotational axis of the rotor at a speed differing from that of the rotor.

Within the scope of the invention the outlet member may be formed as a paring member, i.e. so that it transforms rotational movement of liquid in said chamber into pressure energy, when the liquid is discharged from the chamber. It does not have to be formed in this way, however. Discharge of liquid from said chamber through the outlet member may alternatively be accomplished only by means of the pressure prevailing in the liquid in the chamber and caused by the rotation of the liquid.

The present invention also concerns a centrifugal separator comprising a centrifugal rotor and an outlet device of the above described kind, arranged for discharging liquid out of the centrifugal rotor.

BRIEF DESCRIPTION OF THE DRAWING

The invention is described in the following with reference to the accompanying drawing, in which one embodiment of the invention is illustrated.

FIG. 2 shows an outlet part of the centrifugal rotor in FIG. 1 and the outlet device according to the invention.

FIG. 3 shows a part of the outlet device according to the invention.

DETAILED DESCRIPTION

Figure 1:
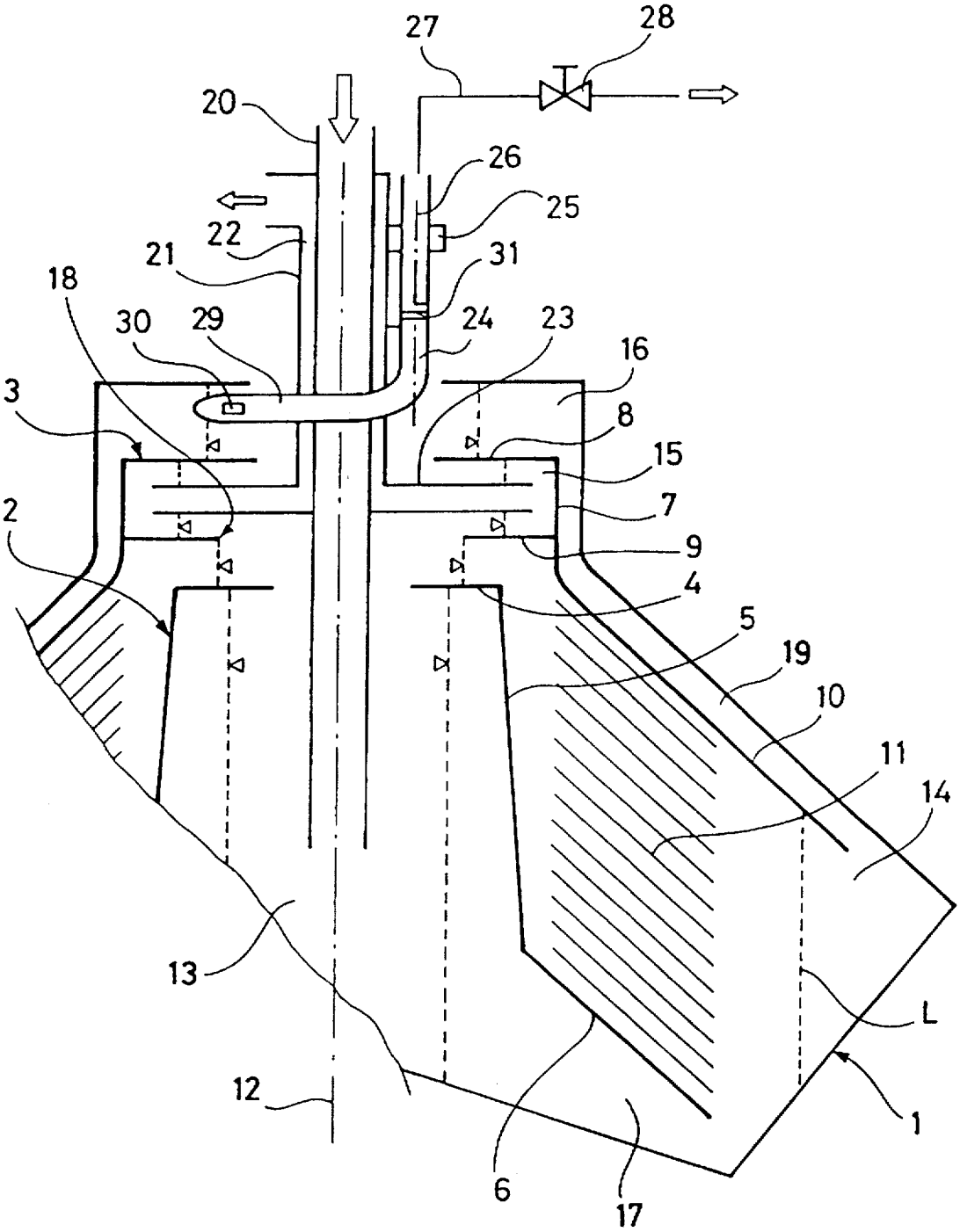
FIG. 1 shows schematically a part of a centrifugal rotor in a longitudinal section and an outlet device according to the invention.

FIG. 1 shows schematically a part of a rotationally symmetric centrifugal rotor, seen in a longitudinal section. The centrifugal rotor has a rotor body 1, that supports within itself a distributor 2 and a partition unit 3.

The distributor 2 has a plane annular part 4, an upper conical part 5 and a lower conical part 6. The partition unit has a cylindrical partition 7, two plane annular partitions 8 and 9 and a conical partition 10. Between the conical partition 10 and the lower conical part 6 of the distributor is arranged a stack of frusto-conical separation discs 11, which by means of spacing members (not shown) are kept at some axial distance from each other.

The rotor body 1, the distributor 2, the partition unit 3 and the separation discs 11 are rotatable together around a central rotational axis 12.

Centrally in the rotor there is formed an inlet chamber 13 by the distributor 2. Around the distributor there is formed between this and the rotor body 1 a separation chamber 14. Radially inside the cylindrical partition 7 there is formed axially between the annular partitions 8 and 9 a lower outlet chamber 15. Above the annular partition 8 there is formed between this and the rotor body 1 an upper outlet chamber 16.

The inlet chamber 13 communicates with the separation chamber 14 through several radially or otherwise extending channels 17. The separation chamber 14 communicates with the lower outlet chamber 15 through an overflow outlet 18 formed by a radially inner edge of the annular partition 9, and with the upper outlet chamber 16 through several channels 19.

A stationary inlet pipe 20 extends into the rotor body 1 from above and opens at its lower end in the inlet chamber 13. The upper part of the inlet pipe 20 is surrounded concentrically by an outlet pipe 21. The two pipes 20 and 21 form between themselves an annular outlet channel 22. At its lower end the outlet channel 22 communicates with the interior of a paring member 23, which is arranged in the lower outlet chamber 15.

A further outlet pipe 24 is supported by means of a supporter 25 by the outlet pipe 21 in a way such that it is turnable around a turning axis 26 extending in parallel with and at some distance from the rotational axis 12 of the rotor. The outlet pipe 24 is connected to an outlet conduit 27 in which there is arranged a closing valve 28.

The shape of the outlet pipe 24 can best be seen in FIG. 2. As shown, the lower part of the outlet pipe 24, which is situated in the outlet chamber 16, forms an arcuate outlet member 29 which extends around part of the outlet pipe 21 and has an inlet opening 30 on its side facing away from the rotational axis 12 of the rotor.

The part of the outlet pipe 24 extending in parallel with the rotational axis 12 of the rotor supports a spring 31. The spring 31 is formed by a spring thread which by a number of turns surrounds the outlet pipe 24 and with its one end portion 32 is fixed to this outlet pipe and by its other end portion 33 resiliently abuts against the outlet pipe 21. The spring 31 in this way is adapted to actuate the outlet pipe 24 by a known, controlled spring force in a direction counter-clockwise around the turning axis 26, seen from above with reference to FIG. 1. The spring 31 thus presses the outlet member 29 away from the rotational axis 12 of the rotor in the outlet chamber 16.

A stopping member (not shown) is arranged to limit the counter-clockwise turning of the outlet member 24 so that the outlet member 29 is prevented from getting into contact with the rotor body 1 in the outlet chamber 16. If desired, means may be arranged to limit the counterclockwise turning of the outlet pipe 24 at any desired position of the outlet member 29, the outlet member 29, however, then having a possibility to be moved from each such position closer to the rotational axis 12 of the rotor against the action of the spring 31.

FIG. 3 shows the outlet member 29 in a section taken across the rotational axis 12 of the rotor. The outlet member 29 has a channel 34 extending from the previously mentioned inlet opening 30 to the interior of the outlet pipe 24.

FIG. 3 also shows the position of a cylindrical liquid surface 35 formed in the outlet chamber 16. The liquid body in the outlet chamber 16, which forms the liquid surface 35, rotates during operation of the centrifugal rotor around the rotational axis 12 in a direction that is illustrated by an arrow 36.

The outlet member 29 that is turnable around the turning axis 26 has an inner side 37 that is facing towards the rotational axis 12 of the rotor and an outer side 38 facing away from the same rotational axis. The inlet opening 30 of the outlet member is situated at said outer side 38.

As can be further seen from FIG. 3, the outlet member 29 has on its outer side 38 a protuberance 39 extending into said rotating liquid body. Even the part of said outer side 38, in which the inlet opening 30 is formed, is situated radially outside the liquid surface 35. This happens in an area situated downstream of a point P (FIG. 3) on the liquid surface 35, that is situated on a prolongation of a straight line drawn from the rotational axis 12 through the turning axis 26 of the outlet member 29. Upstream of the outlet opening 30 a part of the outer side 38 of the outlet member is in contact with the rotating liquid body, whereas the rest of the outer side 38 is situated in the liquid free part of the outlet chamber 16. As can be seen from FIG. 3, the outer side 38 in the area of its contact with the rotating liquid body has a radius of curvature that only insignificantly differs from that of the liquid surface 35. This means that the just mentioned part of the outer side 38, situated in contact with the liquid body, forms an angle with the liquid surface 35 in the relevant contact area which is very small, preferably smaller than 10°. The contact of the outer side 38 with the rotating liquid body thereby will generate a very small frictional force. The outlet member 29 will be floating or "surfing" on the liquid surface 35 when pressed by the spring 31 against the rotating liquid body.

The protuberance 39 which partly defines said inlet opening 30 makes the outlet member 29 operating as a paring member, i.e. liquid flowing in through the opening 30 may be transported through the channel 34 and further through the outlet pipe 24 partly by means of the movement energy obtained by the liquid through its rotation in the outlet chamber 16.

It should be noticed, however, that the present invention is not dependent on the outlet member 29 operating as a paring member. Even without a protuberance 39 the outlet member would be able to discharge liquid out of the outlet chamber 16 through an inlet opening on the outer side 38 of the outlet member. This would occur in such a case only by means of the liquid pressure prevailing in the liquid body rotating in the outlet chamber 16 at the depth therein where the outlet opening 30 would be situated as a consequence of the spring 31 pressing the outlet member 29 towards and partly into the liquid body.

In the following it shall be described more in detail how the outlet device according to the invention may be used in connection with a centrifugal rotor of the kind shown in FIG. 1.

It is assumed that the centrifugal rotor according to FIG. 1 is to be used for the separation of two liquids having different densities and forming a suspension. It is further assumed that in this suspension a very small amount of relatively heavy liquid, e.g. water, is suspended in a large amount of relatively light liquid, e.g. oil.

Before the separation operation is started, the centrifugal rotor—after it has been brought into rotation—preferably is charged with a predetermined amount of previously separated relatively heavy liquid. So much heavy liquid is introduced into the rotor that the liquid fills out the radially outermost part of the separation chamber 14 in to the outer edge of the conical partition 10.

After that the supply of suspension through the inlet pipe 20 is started. The suspension is conducted from the inlet pipe 20 through the inlet chamber 13 and the channels 17 into the separation chamber 14, in which it is separated by the centrifugal force in a light liquid and a heavy liquid. A substantially cylindrical interface layer L (FIG. 1) is formed in the separation chamber 14 between the separated light liquid and the separated heavy liquid. While separated heavy liquid is collected in the radially outermost part of the separation chamber, together with the amount of previously supplied liquid present therein, the separated light liquid is displaced radially inwardly in the separation chamber 14.

Eventually the separated light liquid reaches radially into the overflow outlet 18 and overflows into the outlet chamber 15. The separated heavy liquid eventually reaches through the channels 19 the outlet chamber 16, where it forms a free cylindrical surface moving radially inwardly.

The outlet member 29 situated in the outlet chamber 16 is kept by the spring 31 in its radially outermost position, prevented from moving further outwardly by a previously mentioned stopping member cooperating with the outlet pipe 24. At this stage of the separating operation the valve 28 in the outlet conduit 27 is closed.

When the liquid surface in the outlet chamber 16 reaches the outlet member 29 and continues its movement radially inwardly, since the valve 28 is closed, the outlet member will start to float or be "surfing" on the liquid surface and, thus, be turned clockwise around the turning axis 26 during the continued movement of the liquid surface radially inwardly. The outlet member 29 will thus be subjected to a lifting force by the liquid rotating in the outlet chamber 16, where the liquid hits the inclined outer side 38 of the outlet member 29. This lifting force is counteracted by the controlled force exerted by the spring 31, so that the outlet member is all the time kept in a desired contact with the rotating liquid body.

FIG. 1 illustrates by small triangles the positions of the free liquid surfaces formed in the various chambers of the centrifugal rotor during the separating operation. As can be seen, the liquid surface of the separated heavy liquid in the outlet chamber 16 is situated somewhat more remote from the rotational axis of the rotor than the liquid surface of the separated light liquid in the separation chamber 14.

The position of the liquid surface in the separation chamber 14 is fixed and predetermined by the position of the overflow outlet 18. The paring member 23 is dimensioned such that it will rapidly discharge from the outlet chamber 15 all separated liquid entering into this chamber from the separation chamber 14. However, as described above, the liquid surface in the outlet chamber 16 is still free to move radially inwardly.

Since separated heavy liquid can not leave the centrifugal rotor through the outlet pipe 24, the amount of such separated liquid will increase in the separation chamber 14. This leads to the consequence that the previously mentioned interface layer L between separated light liquid and separated heavy liquid will be displaced radially inwardly in the separation chamber 14. Simultaneously, for the same reason, the free liquid surface in the outlet chamber 16 will be displaced further radially inwardly.

When the interface layer L has reached a certain level in the separation chamber 14, the separation in the separation chamber will deteriorate and fractions of heavy liquid will start to accompany the light liquid out of the rotor through the outlet chamber 15 and the outlet channel 22. This can be sensed, e.g. by means of a dielectric constant meter arranged in the liquid flow through the outlet channel 22.

Upon sensing of heavy liquid in the outlet channel 22 a signal automaticly goes from the control unit of the centrifugal separator (not shown) to the valve 28 that is then opened and kept open during a predetermined period of time. When the valve 28 is opened, the outlet member 29 starts to conduct separated heavy liquid out of the outlet chamber 16 through the channel 34 and further through the outlet pipe 24 to the outlet conduit 27 and a recipient for such liquid.

The outflow of heavy liquid from the outlet chamber 16 causes new liquid to flow into this chamber from the separation chamber 14 through the channels 19, the interface layer L then moving radially outwardly.

When said period of time has expired and, thus, the valve 28 is closed, the interface layer L is again situated in the vicinity of but still radially inside of the outer edge of the conical partition 10. The separating operation having continued during the whole of the described course continues as before, the interface layer L now again slowly beginning to move radially inwardly until the valve 28 is again opened.

During the described course the outlet member 29, after it got into contact with the liquid surface in the outlet chamber 16, has first moved radially inwardly until the valve 28 was opened and, then, moved radially outwardly while separated heavy liquid was discharged therethrough. The movement radially outwardly of the outlet member 29 finished when the valve 28 was closed, i.e. the previously mentioned stopping member did not have to get into action, whereafter the outlet member continued to float or be "surfing" on the liquid surface in the outlet chamber 16. Thus, during the whole course, independent of which position the liquid surface in the outlet chamber 16 has had, the outlet member 29 has had a substantially equally sized part of its surface in contact with the liquid body rotating in the outlet chamber 16. In other words, the problem coming up in connection with radial movements of a liquid surface in an outlet chamber, in which there is arranged a radially immovable outlet member, has been avoided.

In this connection it should be mentioned that the invention constitutes a solution to this particular problem in connection with a separating operation, which is described in U.S. Pat. No. 4,525,155 and in which—as described above—a separated heavy liquid is to be discharged intermittently from an outlet chamber. It should also be mentioned that this problem has previously been resolved in a different way, which is described in U.S. Pat. No. 4,622,029 and which means a circulation pumping of liquid in the area of said outlet chamber 16. A circulation pumping of this kind is connected with certain disadvantages, which do not appear when the present invention is used.

The above described separating operation is only one of several, in which the advantages of an outlet device according to the invention can be used. In the following one further shall be briefly described.

A centrifugal rotor of the kind schematically shown in FIG. 1 normally has one further outlet. Such an outlet is situated at the radially outermost part of the rotor and is intended for intermittent discharge from the separation chamber of heavy solid particles separated therein. A rotor having an outlet of this kind is shown for instance in each one of said U.S. Pat. No. 4,525,155 and U.S. Pat. No. 4,622,029.

In a conventional centrifugal rotor of this kind separated heavy liquid is usually conducted—like separated light liquid—out of the rotor continuously, i.e. not discontinuously as described above in connection with FIG. 1. When both of the two separated liquids are conducted out of the rotor continuously, radially immovable outlet members do not create problems of the same magnitude during the separating operation as when one of the liquids is discharged intermittently, because radial movements of the liquid surfaces in the rotor outlet chambers are then relatively small.

However, a problem is encountered in this respect each time the centrifugal rotor periphery outlet for separated heavy particles is to be opened. In order to avoid, namely, that too much separated light liquid gets lost through the peripheral outlet at each such opening occasion, the separation chamber is filled, totally or partly, with separated heavy liquid before the peripheral outlet is opened. This is performed in a way such that the outlet for separated heavy liquid is closed, whereafter separated light liquid is displaced radially inwardly and out through the ordinary central outlet for light liquid by interruption of the ordinary supply of suspension to the rotor and replacing it by supply of only previously separated heavy liquid.

During such a displacement of the separated light liquid not only the interface layer between light liquid and heavy liquid is moved in the separation chamber radially inwardly. Also the surface of separated heavy liquid in the outlet chamber for heavy liquid moves radially inwardly.

By use of an outlet device according to the invention, instead of a conventional radially immovable outlet device, in the outlet chamber for separated heavy liquid it can be avoided that movements of the liquid surface in the outlet chamber causes unnecessarily large energy consumption for rotation of the centrifugal rotor and an unnecessarily high liquid pressure in the outlet conduit for separated heavy liquid.

FIG. 3 shows in addition to the full circular line 35 two dash-dotted circular lines concentric therewith. These only indicate alternative positions for the liquid surface in the outlet chamber 16.

If an outlet device according to the invention is used in a centrifugal rotor, e.g. of the kind shown in FIG. 1, in order continuously to discharge a separated liquid from an outlet chamber, the outlet pipe 24 by means of the spring 31 can be held against the above described stopping member, so that the outlet member 29 while it discharges liquid out of the rotor is situated all the time at an unchanged distance from the rotational axis of the rotor. This presupposes that there is no obstacle for discharge of all such separated liquid entering the outlet chamber from the separation chamber. The position of the outlet member thus determines in this case the position of the free liquid surface in the outlet chamber. The outlet device may be provided with equipment for maintaining the outlet member 29 by means of the spring 31 in any desired position, whereby the liquid surface in the outlet chamber may be maintained at a desired level independent of the size of the flow of liquid to the outlet chamber. An outlet device of this kind may be used in order to, upon need, change the position during operation of the rotor for the liquid surface in the outlet chamber and the position of the interface layer L (FIG. 1) in the separation chamber of the rotor.

The invention has been described above only in combination with a centrifugal rotor having two central outlets for separated liquids. An outlet device according to the invention can be used, however, even as a single outlet device in a centrifugal rotor having only one central outlet for a separated liquid. It is of course also possible to use two outlet devices according to the invention in one and the same centrifugal rotor for discharging different separated liquids.

What is claimed is:

1. An outlet device for a centrifugal rotor (1) that is rotatable around a rotational axis (12) and delimits a chamber (16) which is formed such that a liquid present therein forms upon rotation of the centrifugal rotor a liquid body having a free liquid surface (35) facing towards and surrounding the rotational axis, the outlet device comprising an outlet member (29) which forms an outlet channel (34) and an inlet opening (30) communicating therewith and which is adapted during operation of the centrifugal rotor to be turnable around a turning axis (26) extending substantially in parallel with said rotational axis (12) at some distance therefrom, so that the outlet member (29) is movable in a direction towards or away from the rotational axis (12) of the centrifugal rotor, the outlet member (29) further being formed such that in different turning positions around said turning axis (26) it extends from a liquid free part of said chamber (16) out into the liquid body present therein through said free liquid surface (35), and actuation means (31) arranged to actuate the outlet member (29) by a controlled force striving at turning the outlet member around said turning axis (26) in a direction away from the rotational axis (12) of the centrifugal rotor, so that the outlet member, against the action of forces which are exerted thereon by the liquid body rotating with the centrifugal rotor, is held with its inlet opening (30) at least partly in the liquid body at varying radial levels of the free liquid surface (35), wherein the outlet member (29) has a shape such that during operation of the centrifugal rotor it extends from the liquid free part of said chamber (16) out into the liquid body present therein through an area of the free liquid surface (35), which area is situated downstream of a point (P) on the free liquid surface (35), which point (P) is situated on a prolongation of a straight line drawn from the rotational axis (12) of the centrifugal rotor through said turning axis (26).

2. An outlet device according to claim 1, in which said inlet opening (30) during operation of the centrifugal rotor is placed such that a radius extending from the rotational axis (12) of the centrifugal rotor through the inlet opening (30) forms an angle between 80° and 100°, with said straight line extending through the rotational axis (12) and the turning axis (26).

3. An outlet device according to claim 2, in which the angle is about 90°.

4. An outlet device according to claim 1, in which the outlet channel (34) has an extension such that liquid flowing in through the inlet opening (30) during operation of the centrifugal rotor is forced to change its flow direction in the outlet channel (34) in a way such that, thereby, a reaction force will act on the outlet member (29), which strives at turning the outlet member around said turning axis (26) in a direction towards the rotational axis (12) of the centrifugal rotor.

5. An outlet device according to claim 1, in which the outlet member (29) has an outer side (38), arranged to be in contact with said liquid body, and at least a part of the outer side (38) is inclined in relation to the direction of rotation of the liquid body in a way such that the outlet member (29) on the inclined part of its outer side is subjected to a lifting force caused by the rotating liquid body and directed opposite to said controlled force.

6. An outlet device according to claim 5, in which said outer side (38) of the outlet member (29) forms an angle smaller than 10° with the free liquid surface (35) in said chamber (16) in the area of said outer side (38) having contact with the rotating liquid body in the chamber.

7. An outlet device according to claim 1, in which said controlled force is independent of forces emanating from the rotation of the liquid body.

8. An outlet device according to claim 1, in which said actuation means (31) comprises a spring for actuating the outlet member (29) by said controlled force.

9. An outlet device according to claim 1, in which the outlet member (29) is supported by an outlet pipe (24), at least part of which extends coaxially with said turning axis (26) in parallel with said rotational axis (12), the outlet channel (34) of the outlet member communicating with the interior of the outlet pipe (24).

10. An outlet device according to claim 9, in which the outlet member (29) is substantially tubular and constitutes part of the outlet pipe (24).

11. A centrifugal separator comprising a centrifugal rotor (1) which is rotatable around a rotational axis (12) and delimits a chamber (16) formed in a way such that a liquid present therein forms upon rotation of the centrifugal rotor (1) a liquid body having a free liquid surface (35) facing towards and surrounding the rotational axis (12), wherein the centrifugal separator comprises an outlet device according to claim 1, arranged for discharging liquid out of said chamber (16).

* * * * *